US009284097B2

(12) United States Patent
Heckman

(10) Patent No.: US 9,284,097 B2
(45) Date of Patent: Mar. 15, 2016

(54) CHILD RESISTANT POUCH HAVING RECLOSEABLE ZIPPER AND METHODS

(71) Applicant: Reynolds Presto Products Inc., Richmond, VA (US)

(72) Inventor: Gregory S. Heckman, Menasha, WI (US)

(73) Assignee: Reynolds Presto Products Inc., Lake Forest, IL (US)

( * ) Notice: Subject to any disclaimer, the term of this patent is extended or adjusted under 35 U.S.C. 154(b) by 0 days.

(21) Appl. No.: 14/205,552

(22) Filed: Mar. 12, 2014

(65) Prior Publication Data

US 2014/0270585 A1 Sep. 18, 2014

Related U.S. Application Data

(60) Provisional application No. 61/790,935, filed on Mar. 15, 2013.

(51) Int. Cl.
*B65D 33/00* (2006.01)
*B65D 33/25* (2006.01)

(52) U.S. Cl.
CPC ..... *B65D 33/2508* (2013.01); *B65D 2215/08* (2013.01)

(58) Field of Classification Search
CPC ..... B65D 33/2533; B65D 33/2591; B65D 33/2541; B65D 33/2508; B65D 33/255
USPC ..... 383/61.2, 63
See application file for complete search history.

(56) References Cited

U.S. PATENT DOCUMENTS

| | | | | |
|---|---|---|---|---|
| 4,817,188 | A | 3/1989 | Van Erden | |
| 4,878,763 | A | 11/1989 | Ausnit | |
| 5,017,021 | A | 5/1991 | Simonsen et al. | |
| 5,216,787 | A * | 6/1993 | Custer et al. | 24/585.12 |
| 5,372,428 | A * | 12/1994 | Bruno et al. | 383/5 |
| 5,660,479 | A | 8/1997 | May et al. | |
| 5,672,009 | A | 9/1997 | Malin | |
| 5,709,915 | A * | 1/1998 | Tomic et al. | 428/35.2 |
| 6,004,032 | A | 12/1999 | Kapperman et al. | |
| 6,065,872 | A * | 5/2000 | Johnson | 383/63 |
| 6,550,965 | B2 * | 4/2003 | Shaffer et al. | 383/65 |
| 6,955,465 | B2 | 10/2005 | Machacek et al. | |
| 7,437,805 | B2 * | 10/2008 | Berich | 24/399 |
| 7,674,039 | B2 * | 3/2010 | McMahon et al. | 383/61.2 |
| 7,758,242 | B2 | 7/2010 | May et al. | |
| 7,886,412 | B2 * | 2/2011 | Dais et al. | 24/585.12 |
| 8,061,898 | B2 * | 11/2011 | Pawloski et al. | 383/59 |
| 2005/0196076 | A1 * | 9/2005 | Tanaka et al. | 383/63 |
| 2006/0034551 | A1 * | 2/2006 | Linneweil | 383/61.2 |
| 2006/0111226 | A1 * | 5/2006 | Anzini et al. | 493/214 |
| 2007/0183692 | A1 * | 8/2007 | Pawloski | 383/61.2 |
| 2008/0232722 | A1 * | 9/2008 | Pawloski et al. | 383/64 |
| 2012/0045151 | A1 * | 2/2012 | Eouzan | 383/42 |
| 2014/0161374 | A1 * | 6/2014 | Septien Rojas et al. | 383/63 |

* cited by examiner

*Primary Examiner* — J. Gregory Pickett
*Assistant Examiner* — Peter Helvey
(74) *Attorney, Agent, or Firm* — Merchant & Gould P.C.

(57) ABSTRACT

A reclosable zipper pouch includes a zipper-operable section and a zipper-non-operable section to provide difficulty to a child to open the pouch, and remain easy for an adult or senior citizen to open the pouch.

5 Claims, 5 Drawing Sheets

36
24
70
60
45
40
56
42
76
86
48
50
44
66
62
64
58
51
67
49
74
88
28
26
54
61
46
72
79
78

CHILD RESISTANT POUCH HAVING RECLOSEABLE ZIPPER AND METHODS

This application claims priority to U.S. provisional patent application 61/790,935, filed Mar. 15, 2013, incorporated herein by reference in its entirety.

TECHNICAL FIELD

This disclosure relates to reclosable zipper pouch. More particularly, this disclosure relates to a reclosable zipper pouch that is child resistant.

BACKGROUND

A reclosable pouch having a press to close zipper closure is easy to open for children and adults. If the pouch is intended to have contents that are potentially harmful, there is a need to provide a closure and method to increase the difficulty for children to open the pouch and yet still be easy to open for adults and senior citizens.

SUMMARY

In one aspect, this disclosure relates to a reclosable zipper pouch including a surrounding wall having a closed bottom, first and second opposite sides, an open mouth, and first and second opposing wall panels between the first and second opposite sides. The pouch includes a first zipper profile and a second zipper profile. The first zipper profile includes a first seal flange and a first profile member extending from the first seal flange. The first seal flange is secured to the first wall panel adjacent to the mouth and between the first and second sides to provide the first profile member extending from the first seal flange toward the second wall panel. The second zipper profile includes a second seal flange and a second profile member extending from the second seal flange. The second seal flange is secured to the second wall panel adjacent to the mouth and between the first and second sides to provide the second profile member extending from the second seal flange toward the first panel and in a location to engage the first profile member. The first and second profile members are constructed and arranged to selectively interlock when pressed together and unlocked when forced apart. The second seal flange is secured to the second wall panel at a zipper-operable section and a zipper-non-operable section. The zipper-operable section is constructed and arranged so that when a pulling force is applied at the zipper-operable section to the first and second zipper profiles, the first and second profile members will unlock. The zipper-non-operable section is constructed and arranged so that when a pulling force is applied at the zipper-non-operable section to the first and second zipper profiles, the first and second profile members will not unlock.

In example embodiments, the zipper-operable section includes a lower attachment region between the second seal flange and the second wall panel, and between the second profile member and the closed bottom. The zipper-operable section can include an upper attachment region between the second seal flange and the second wall panel and between the second profile member and the mouth.

In example aspects, the zipper-non-operable section includes at least a lower attachment region between the second seal flange and the second wall panel and between the second profile member and the closed bottom.

In example aspects, the second seal flange includes a die line substantially along a length of the second zipper profile between the first and second sides and between the second profile member and the mouth. The upper attachment region of the zipper-operable section extends at least on the die line. The zipper-non-operable section includes an upper attachment region between the second seal flange and the second wall panel and between the die line and the mouth. A region between the die line and the second profile member is free of attachment.

In an example embodiment, the zipper-non-operable section is free of attachment between the second seal flange and the second wall panel, and between the second profile member and the mouth.

In another aspect, a method of making a reclosable zipper pouch is provided. The method includes providing a surrounding wall having a closed bottom, first and second opposite sides, an open mouth, and first and second opposing wall panels between the first and second opposite sides. The method includes providing a first zipper profile and providing a second zipper profile. The first zipper profile includes a first seal flange and a first profile member extending from the first seal flange. The method includes securing the first seal flange to the first wall panel adjacent to the mouth and between the first and second sides to provide the first profile member extending from the first seal flange toward the second wall panel. The second zipper profile includes a second seal flange and a second profile member extending from the second seal flange. The method includes securing the second seal flange to the second wall panel adjacent to the mouth and between the first and second sides to provide the second profile member extending from the second seal flange toward the first panel and in a location to engage the first profile member. The first and second profile members are constructed and arranged to selectively interlock when pressed together and unlocked when forced apart. The step of securing the second seal flange to the second wall panel includes securing the second seal flange at a zipper-operable section and a zipper-non-operable section. The zipper-operable section is constructed and arranged so that when a pulling force is applied at the zipper-operable section to the first and second zipper profiles, the first and second profile members will unlock. The zipper-non-operable section is constructed and arranged so that when a pulling force is applied at the zipper-non-operable section to the first and second zipper profiles, the first and second profile members will not unlock.

A variety of examples of desirable product features or methods are set forth in part in the description that follows, and in part will be apparent from the description, or may be learned by practicing various aspects of this disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

Figure 1:
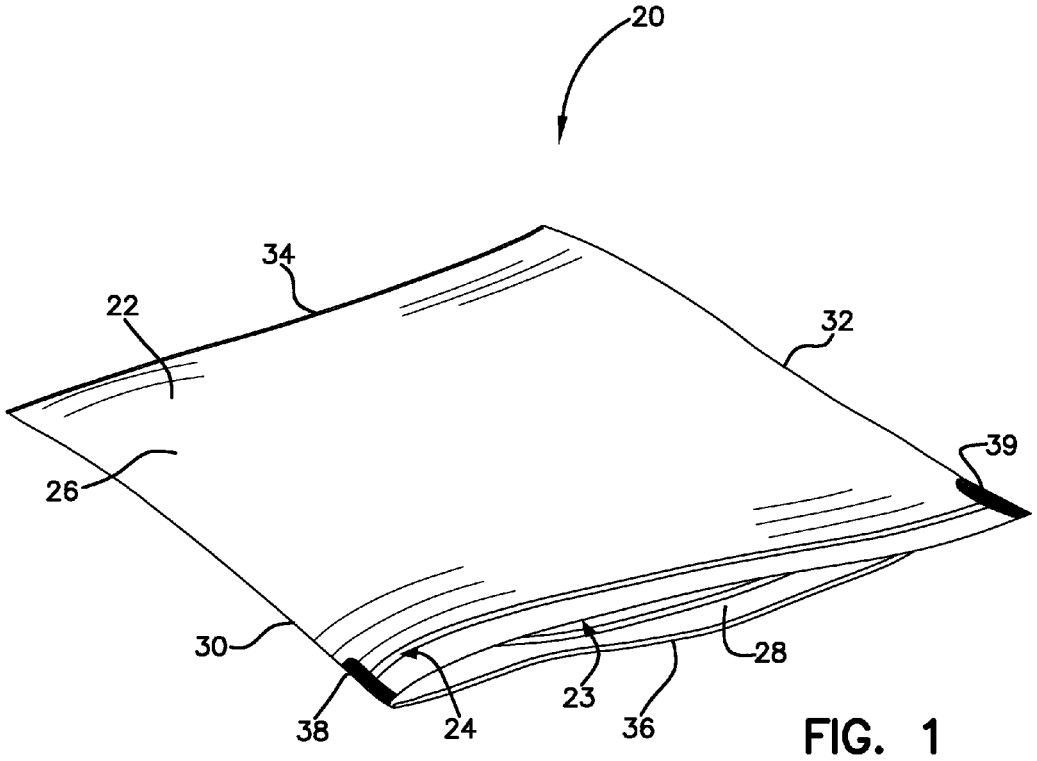
FIG. 1 is a schematic, perspective view of a reclosable pouch incorporating the zipper closure, constructed in accordance with principles of this disclosure.
Figure 2:
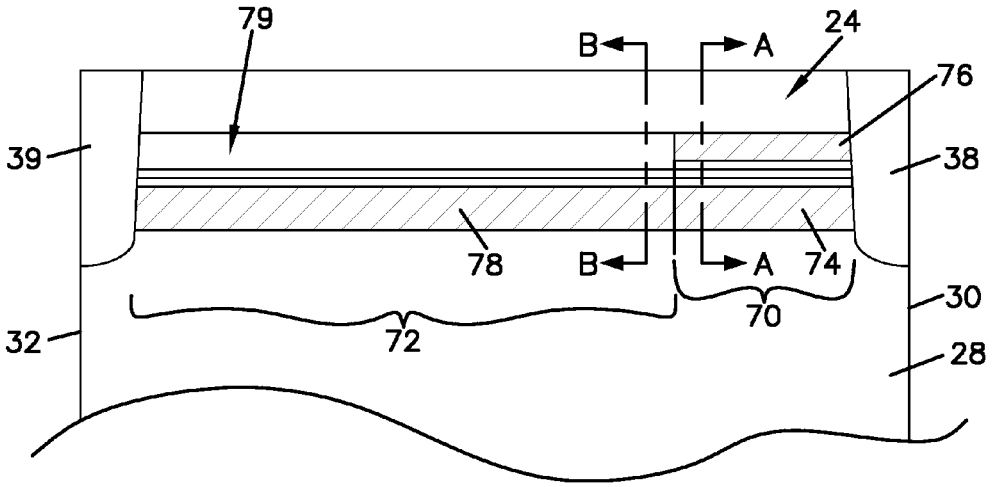
FIG. 2 is a rear view of a portion of the reclosable pouch of FIG. 1 and showing a first embodiment of a zipper closure constructed in accordance with principles of this disclosure.
Figure 3:
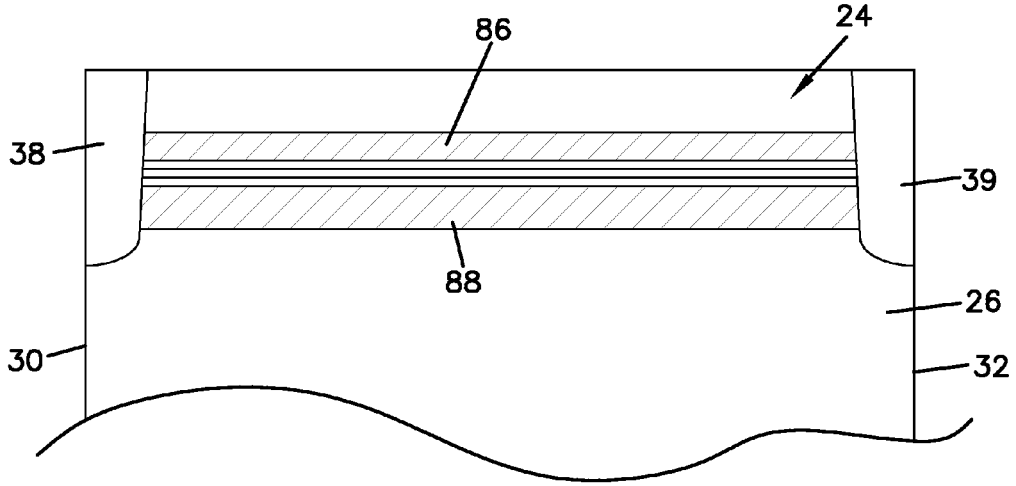
FIG. 3 is a front view of the portion of the reclosable pouch depicted in FIG. 2.

FIG. 1 illustrates a reclosable zipper pouch generally at 20. The pouch 20 will generally be flexible and can be made from a polymeric film, although other materials are usable. The pouch 20 includes a surrounding wall 22. The surrounding wall 22 encloses an interior volume 23. A reclosable zipper closure 24 is part of the pouch 20 to allow for selective closing and opening of the pouch 20 to either allow access to the interior volume 23 or block access to the interior volume 23.

The surrounding wall 22 includes first and second wall panels 26, 28 in opposition to each other. First and second sides 30, 32 join the first and second wall panels 26, 28. In some embodiments, the first and second sides 30, 32 can be seals connecting together the first and second wall panels 26, 28, while in other embodiments, the first and second sides 30, 32 are not seals, but merely form the sides 30, 32.

The pouch 20 includes a closed bottom 34. The closed bottom 34, in this embodiment, is between the first side 30 and second side 32 and at an opposite end of the pouch as the reclosable zipper closure 24. The closed bottom 34 can be part of the same single piece of material that forms the first wall panel 26 and second wall panel 28; alternatively, the closed bottom 34 can be a seal connecting together the first wall panel 26 and second wall panel 28.

The pouch 24 has an open mouth 36 at the end of the pouch 20 that is opposite from the closed bottom 34. The mouth 36 provides access to the interior volume 23, when the reclosable zipper closure 24 is in an unlocked position. When the reclosable zipper closure 24 is in a locked position, access to the interior volume 23 is blocked.

Side seal crushes 38, 39 can be seen along the sides 30, 32 securely attaching and sealing the zipper closure 24 along the sides 30, 32 of the pouch 20.

The reclosable zipper closure 24 in the pouch 20 is constructed to increase the difficulty for children to open the pouch 20 and gain access to the contents of the interior volume 23, while still allowing easy opening for adults or senior citizens. One example embodiment is shown in FIGS. 2-6, and a second example embodiment is shown at 24' in FIGS. 7-10. The same reference numerals will be used for analogous parts in these embodiments.

The reclosable zipper pouch 20 includes a first zipper profile 40. The first zipper profile 40 has a first seal flange 42 and a first profile member 44 extending from the first seal flange 42. In general, the first zipper profile 40 will be a molded extrusion of a polymeric material.

In the example embodiments depicted, the first profile member 44 is spaced from each end 45, 46 of the first seal flange 42. In general, it can be desirable to have the first profile member 44 spaced sufficiently from each end 45, 46 to allow for a seal to be placed both above and below the first profile member 44.

Many embodiments are possible. In the example shown, the first profile member 44 is a female profile member having a pair of legs 48, 49 extending from the first seal flange 42 and ending at hooked free ends 50, 51. The legs 48, 49 are spaced sufficiently apart to receive and interlock or engage with a male profile member, to be discussed further below.

The first seal flange 42 is secured to the first wall panel 26 adjacent to the mouth 36 and between the first and second sides 30, 32. In this manner, the first profile member 44 extends from the first seal flange 42 in a direction toward the second wall panel 28.

The pouch 20 includes a second zipper profile 54 including a second seal flange 56 and a second profile member 58 extending from the second seal flange 56. In general, the second zipper profile 54 will be a molded extrusion of a polymeric material.

The second seal flange 56 has opposite flange ends 60, 61. In general, the second profile member 58 will be spaced from both of the flange ends 60, 61. In the example shown, the second profile member 58 can be generally centered between the flange ends 60, 61, although there can be many variations.

The second profile member 58 extends from the second seal flange 56 toward the first wall panel 26 and in a location to engage the first profile member 44.

Many embodiments are possible. In the particular embodiment shown, the second profile member 58 is a male member having a stem 62 extending from the second seal flange 56 and ending at an arrowhead 64. The arrowhead 64 includes a pair of arms 66, 67 extending therefrom. The arrowhead 64 is shaped to be received between the legs 48, 49 of the first profile member 44, and have the arms 66, 67 engage the hooked free ends 50, 51 of the legs 48, 49. In this manner, it should be appreciated that the first and second profile members 44, 58 are constructed and arranged to selectively interlock when pressed together and unlock when forced apart.

The second seal flange 56 is secured to the second wall panel 28 adjacent to the mouth 36 and between the first and second sides 30, 32, such that the first and second profile members 44, 58 can be selectively pressed together to interlock and block access to the interior volume, and be forced apart to unlock and provide access to the interior volume 23 through the mouth 36.

The second seal flange 56 is secured to the second wall panel 28 at a zipper-operable section 70 and a zipper-non-operable section 72. The zipper-operable section 70 is constructed and arranged so that when a pulling force is applied at the zipper-operable section 70 from the consumer side (along the mouth 36) to the first and second zipper profiles 40, 54, the first and second profile members 44, 58 will disengage and unlock to provide access to the interior volume 23. The zipper-non-operable section 72 is constructed and arranged so that when a pulling force is applied at the zipper-non-operable section 72 from the consumer side along the mouth 36 to the first and second zipper profiles 40, 54, the first and second profile members 44, 58 will not unlock, but stay engaged and block access to the interior volume 23.

The zipper-operable section 70 includes a lower attachment region 74 between the second seal flange 56 and the second wall panel 28. The attachment region 74 also extends between the second profile member 58 and the closed bottom 34 of the pouch 20. The zipper-operable section 70 further includes an upper attachment region 76 between the second seal flange 56 and the second wall panel 28 and extending between the second profile member 58 and the mouth 36.

The zipper-non-operable section 72 includes at least a lower attachment region 78 between the second seal flange 56 and the second wall panel 28. The lower attachment region 78 also is between the second profile member 58 and the closed bottom 34. The lower attachment region 78 can include adhesive, sealant, a heat seal, and many other techniques for attaching the second profile member 58 to the wall panel 28. From a review of FIG. 2, in the embodiment shown, it should be appreciate that the lower attachment region 78 of the second seal flange 56 is continuous with the lower attachment region 74 of the second seal flange.

Figures 4, 5, 6:
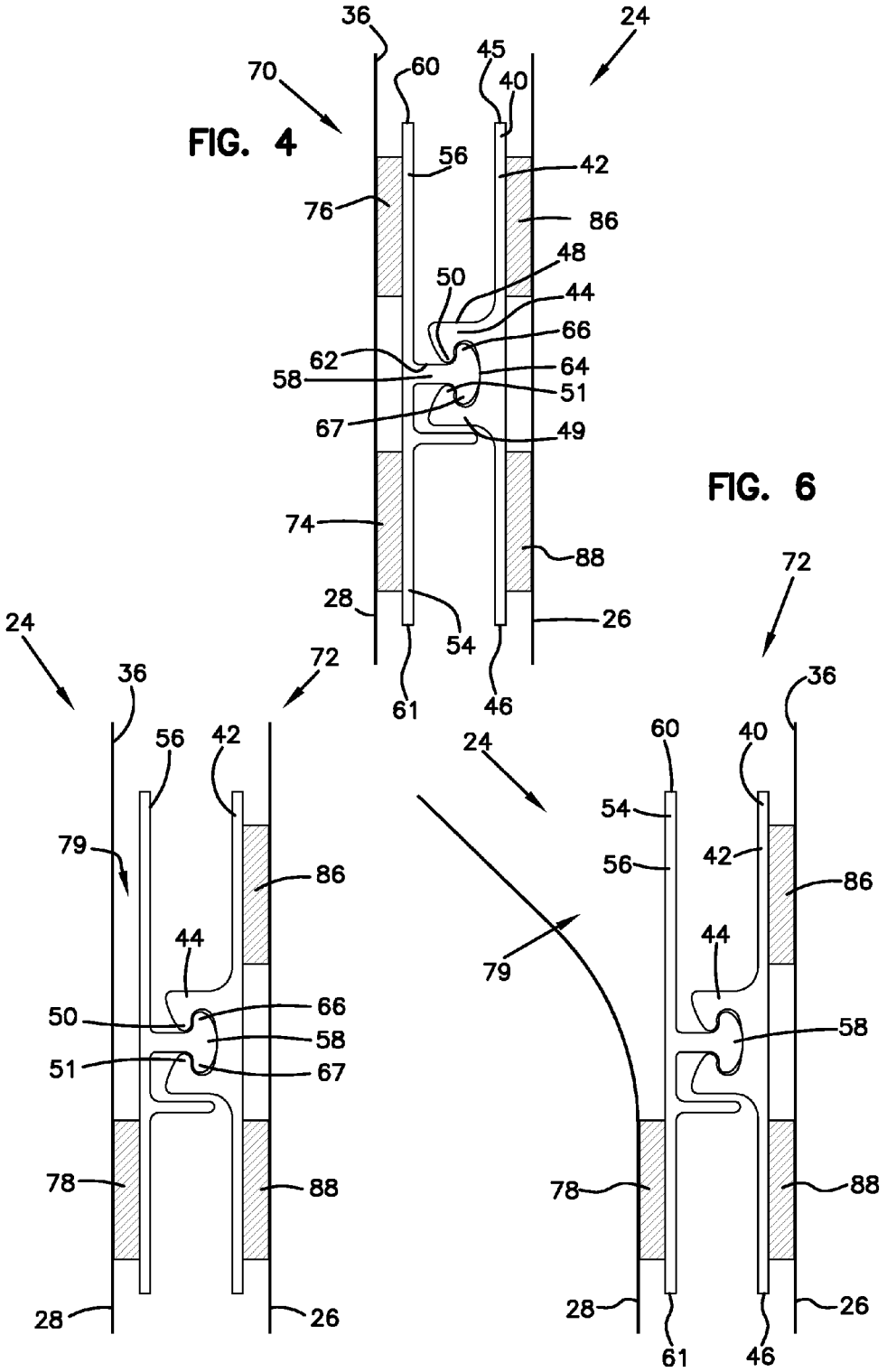
FIG. 4 is a schematic, cross sectional view of the zipper closure of FIGS. 2 and 3, the cross section being taken along the line A-A of FIG. 2.
FIG. 5 is a schematic, cross sectional view of the zipper closure used in FIGS. 2 and 3, the cross section being taken along the line B-B of FIG. 2.
FIG. 6 is the zipper closure cross section of FIG. 5, and showing one of the pouch panels moved in a direction away from the zipper closure.
Figure 7:
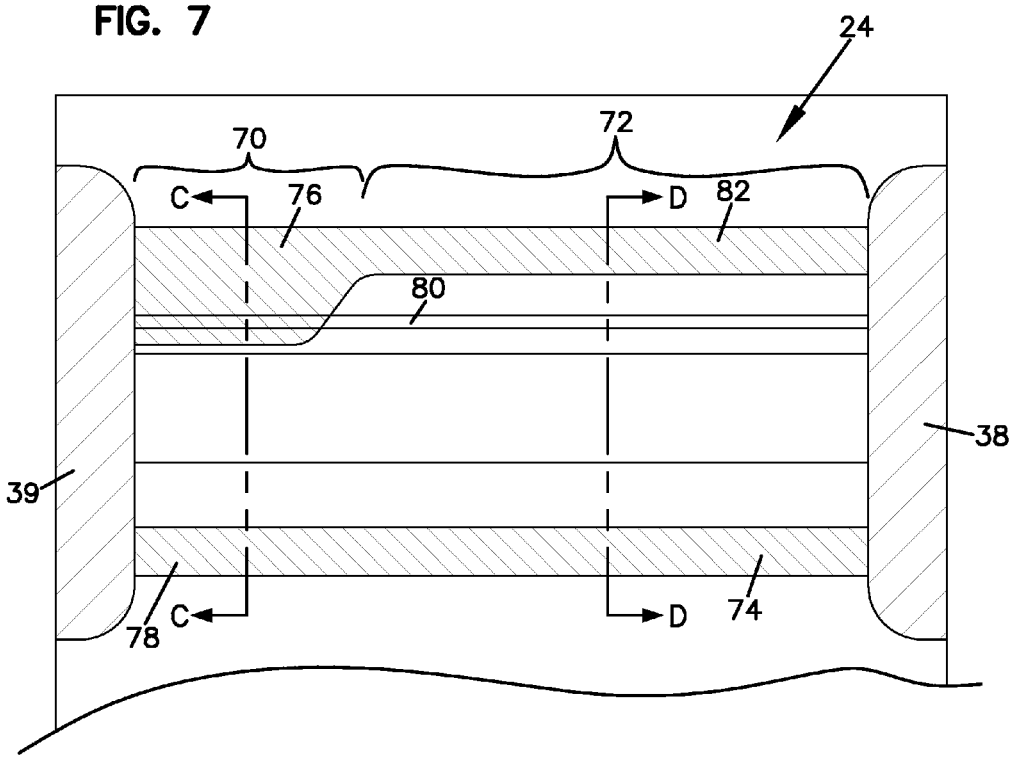
FIG. 7 is a schematic view of a front portion of a reclosable pouch and zipper closure according to a second embodiment.

In reference now to the embodiment of FIGS. 2-6, the zipper-non-operable section 72 is free of attachment between the second seal flange 56 and the second wall panel 28, and between the second profile member 58 and the mouth 36. As can be seen in FIG. 5, in the zipper-non-operable section 72, there is only the single attachment region at lower attachment region 78. This lower attachment region 78 is below the second profile member 58, and the region 79 above the second profile member 58 is free of any type of attachment between the second zipper profile 54 and the wall panel 28.

In both embodiments, the first seal flange 42 is secured to the first wall panel 26 adjacent along at least an upper attachment region 86 between the first profile member 44 and the mouth 36. The first seal flange 42 is also secured to the first wall panel 26 at a lower attachment region 88 between the first profile member 44 and the bottom 34.

FIG. 6 illustrates what happens when a force is applied to pull first zipper profile 40 and second zipper profile 54 apart in the zipper-non-operable section 72. The second wall panel 28 is moved away from the second zipper profile 54. Because there is no pulling force applied to the second seal flange 56 in the region above the second profile member 58 adjacent to the mouth 36, the first and second profile members 44, 58 will be more difficult to disengage and unlock than, for example, in the zipper-operable section 70. In the zipper-operable section 70, because there is the upper attached region 76 between the mouth 36 and second profile member 58, when a pulling force is applied to the second wall panel 58 in the region of the mouth 36, the pulling force will transfer to the second seal flange 56 and to the second profile member 58 and more easily pull apart the profile members 54, 58 into an unlocked state.

Figure 8:
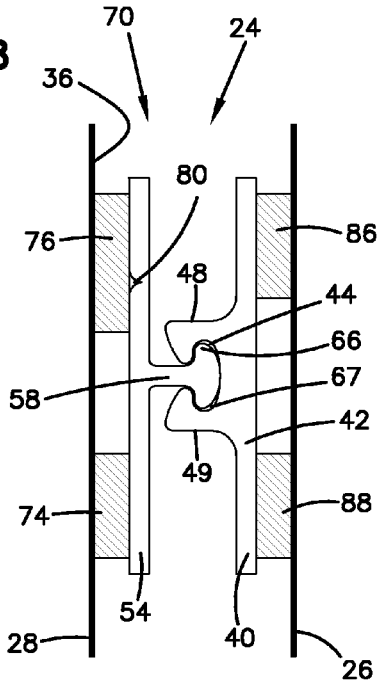
FIG. 8 is a cross sectional view of the zipper closure used in the embodiment of FIG. 7, the cross section being taken along the line C-C.

Attention is now directed to the embodiment of FIGS. 7-10. In this embodiment, the second seal flange 56 includes a die line 80 substantially along a length of the second zipper profile 54 between the first and second sides 30, 32 and between the second zipper profile member 58 and the mouth 36. In FIGS. 7-10, in the zipper-operable section 70, the upper attachment region 76 extends at least on or covering the die line 80. As can be seen in FIG. 8, the upper attachment region 76 in the zipper-operable section 70 is not only on the die line 80, but also above the die line 80 and below the die line 80, but still above the second profile member 58.

Figure 9:
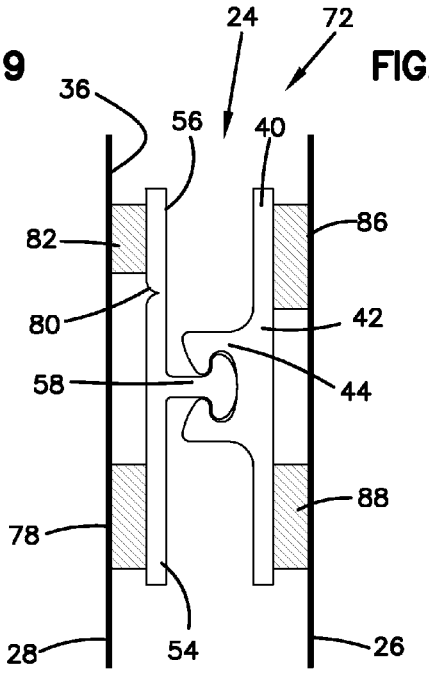
FIG. 9 is a cross sectional view of the zipper closure of FIG. 7, the cross section being taken along the line D-D of FIG. 7.
Figure 10:
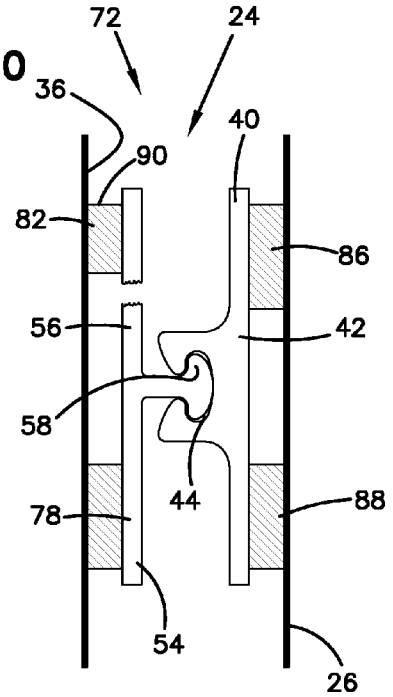
FIG. 10 is the cross section of FIG. 9, but showing a broken die line in the zipper closure.

In reference to FIGS. 9 and 10, the zipper-non-operable section 72 includes an upper attachment region 82 that is between the second seal flange 56 and the second wall panel 28. The upper attachment region 82 is also between the die line 80 and the mouth 36. A region 84 between the die line 80 and the second profile member 58 in the zipper-non-operable section 72 is free of any attachment between the second seal flange 56 and the second wall panel 28. In the embodiment shown in FIG. 7, the upper attachment region 82 (above the die line 80) is continuous with a portion of the upper attachment region 76 (the portion of 76 above the die line 80) in the zipper-operable section 70.

For the embodiment of FIGS. 7-10, when a person applies a pulling force at the zipper-non-operable section 72, the pulling force at the mouth 36 on the second wall panel 28 will cause the second seal flange 56 to break along the die line 80. This will prevent a further pulling force on the second profile member 58 from a direction above the second profile member 58, and make unlocking or disengagement of the profile members 44, 58 difficult. Broken second seal flange piece 90 can be seen in FIG. 10. When a pulling force is applied at the mouth 36 in the zipper-operable section 70, because there is upper attachment region 76 in covering relation and on the die line 80, the force applied to the second wall panel 28 will transfer to the second seal flange 56 above the second profile member 58, and the die line 80 will not tear. Rather, the pull force will transfer to the second profile member 58 and allow the first profile member 44 and second profile member 58 to be disengaged and separated to permit access to the interior volume 23.

As used throughout, the terms "lower" and "upper" are merely used in order to describe the particular orientation shown in FIGS. 4-6 and 8-10. It should be understood that instead of lower and upper, phrases such as first and second could be used. In use, the pouch 20 can be in any orientation in space, and "an upper attachment region" may appear as a lower region, while a "lower attachment region" may appear as an upper region.

Each of the attachment regions 74, 76, 78, 82, 86, 88 can be with a sealant, adhesive, heat seal, and other techniques for securing the zipper profiles 40, 54 to the wall panel 28.

A method of making a reclosable zipper pouch can be implemented following principles of this disclosure. In the method, there is a step of providing surrounding wall 22 having closed bottom 34, first and second opposite sides 30, 32, open mouth 36, and first and second opposing wall panels 26, 28 between the first and second opposite sides 30, 32.

There is a step of securing the first seal flange 42 of first zipper profile 40 to the first wall panel 26 adjacent to the mouth 36 and between the first and second sides 30, 32 to provide the first profile member 44 to be extending from the first seal flange 42 toward the second wall panel 28.

There is a step of securing the second seal flange 56 of the second zipper profile 54 to the second wall panel 28 adjacent to the mouth 36 and between the first and second sides 30, 32 to provide the second profile member 58 to be extending from the second seal flange 56 toward the first wall panel 26 and in a location to engage the first profile member 44.

The step of securing the second seal flange 56 includes securing the second seal flange 56 at zipper-operable section 70 and at zipper-non-operable section 72.

The step of securing the second flange seal 56 at zipper-operable section 70 includes securing lower attachment region 74 between the second seal flange 56 and the second wall panel 28 and between the second profile member 58 and the closed bottom 34. It also includes securing upper attachment region 76 between the second seal flange 56 and the second wall panel 28 and between the second profile member 58 and the mouth 36. The step of securing the second flange seal 56 at zipper-non-operable section 72 includes securing at least lower attachment region 78 between the second seal flange 56 and the second wall panel 28 and between the second profile member 58 and the closed bottom 34.

The step of providing the second seal flange 56 can include providing second seal flange 56 to have die line 80 substantially along a length of the second zipper profile 54 between the first and second sides 30, 32 and between the second profile member 58 and the mouth 36. In this embodiment, the step of securing the second seal flange 56 at zipper-operable section 70 includes securing the upper attachment region 76 of the zipper-operable section at least on and covering the die line 80. In this embodiment, the step of securing the second seal flange 56 at zipper-non-operable section 72 includes securing upper attachment region 82 between the second flange seal 56 and the second wall panel 28 and between the die line 80 and the mouth 36. Region 84 between the die line 80 and the second profile member 58 is free of attachment.

In one embodiment, the step of securing the second seal flange 56 at zipper-non-operable section 72 includes limiting the attachment of the second seal flange 56 in the zipper-non-operable section 70 to the lower attachment region 78 and ensuring region 79 between the second profile member 58 and the mouth 36 in the zipper-non-operable section 72 is free of attachment between the second seal flange 56 and the second wall panel 28.

The step of securing the first seal flange 42 to the first wall panel 26 includes securing the first seal flange 42 to the first wall panel 26 along at least upper attachment region 86 and lower attachment region 88. The upper attachment region 86 is between the first profile member 44 and the mouth 36. The lower attachment region 88 is between the first profile member 44 and the closed bottom 34.

The above description represents example principles of this disclosure. Many embodiments can be made applying these principles.

What is claimed is:

1. A recloseable zipper pouch comprising:

(a) a surrounding wall having a closed bottom, first and second opposite sides, an open mouth, and first and second opposing wall panels between the first and second opposite sides;

(b) a first zipper profile including a first seal flange and a first profile member extending from the first seal flange;

(i) the first seal flange being secured to the first wall panel adjacent to the mouth and between the first and second sides to provide the first profile member extending from the first seal flange toward the second wall panel;

(c) a second zipper profile including a second seal flange and a second profile member extending from the second seal flange;

(i) the second seal flange being secured to the second wall panel adjacent to the mouth and between the first and second sides to provide the second profile member extending from the second seal flange toward the first wall panel and in a location to engage the first profile member;

(A) a first side seal attachment region along the first side attaching the first zipper profile and second zipper profile along the first side; and a second side seal attachment region along the second side attaching the first zipper profile and second zipper profile along the second side;

(ii) the first and second profile members being constructed and arranged to selectively interlock when pressed together and unlock when forced apart;

(iii) the second seal flange being secured to the second wall panel at a zipper-operable section and a zipper-non-operable section;

(A) the zipper-operable section being constructed and arranged so that when a pulling force is applied at the zipper-operable section to the first and second zipper profiles, the first and second profile members will unlock;

(B) the zipper non-operable section being constructed and arranged so that when a pulling force is applied at the zipper-non-operable section to the first and second zipper profiles, the first and second profile members will not unlock; the zipper non-operable section extending along at least a portion of the second zipper profile between the first side seal attachment region and the second side seal attachment region;

(C) the zipper-operable section including a lower attachment region between the second seal flange and the second wall panel, and being between the second profile member and the closed bottom; and an upper attachment region between the second seal flange and the second wall panel, and being between the second profile member and the mouth; and (D) the zipper-non-operable section including at least a lower attachment region between the second seal flange and the second wall panel, and being between the second profile member and the closed bottom; and the zipper-non-operable section being free of attachment between the second seal flange and the second wall panel, and between the second profile member and the mouth.

2. A recloseable zipper pouch according to claim 1 wherein:

(a) the first seal flange is secured to the first wall panel adjacent along at least an upper attachment region between the first profile member and the mouth, and a lower attachment region between the first profile member and the bottom.

3. A recloseable zipper pouch comprising:

(a) a surrounding wall having a closed bottom, first and second opposite sides, an open mouth, and first and second opposing wall panels between the first and second opposite sides;

(b) a first zipper profile including a first seal flange and a first profile member extending from the first seal flange;

(i) the first seal flange being secured to the first wall panel adjacent to the mouth and between the first and second sides to provide the first profile member extending from the first seal flange toward the second wall panel;

(c) a second zipper profile including a second seal flange and a second profile member extending from the second seal flange;

(i) the second seal flange being secured to the second wall panel adjacent to the mouth and between the first and second sides to provide the second profile member extending from the second seal flange toward the first wall panel and in a location to engage the first profile member;

(ii) the first and second profile members being constructed and arranged to selectively interlock when pressed together and unlock when forced apart;

(iii) the second seal flange being secured to the second wall panel at a zipper-operable section and a zipper-non-operable section;

(A) the zipper-operable section being constructed and arranged so that when a pulling force is applied at the zipper-operable section to the first and second zipper profiles, the first and second profile members will unlock;

(B) the zipper-operable section including a lower attachment region between the second seal flange and the second wall panel, and being between the second profile member and the closed bottom; and an upper attachment region between the second seal flange and the second wall panel, and being between the second profile member and the mouth;

(C) the zipper non-operable section being constructed and arranged so that when a pulling force is applied at the zipper-non-operable section to the first and second zipper profiles, the first and second profile members will not unlock;

(D) the zipper-non-operable section including at least a lower attachment region between the second seal flange and the second wall panel, and being between the second profile member and the closed bottom; and (E) the zipper-non-operable section being free of attachment between the second seal flange and the second wall panel, and between the second profile member and the mouth.

4. A method of making a recloseable zipper pouch, the method comprising:

(a) providing a surrounding wall having a closed bottom, first and second opposite sides, an open mouth, and first and second opposing wall panels between the first and second opposite sides;

(b) providing a first zipper profile including a first seal flange and a first profile member extending from the first seal flange and securing the first seal flange to the first wall panel adjacent to the mouth and between the first and second sides to provide the first profile member extending from the first seal flange toward the second wall panel;

(c) providing a second zipper profile including a second seal flange and a second profile member extending from the second seal flange and securing the second seal flange to the second wall panel adjacent to the mouth and between the first and second sides to provide the second profile member extending from the second seal flange toward the first wall panel and in a location to engage the first profile member; a first side seal attachment region being along the first side attaching the first zipper profile and second zipper profile along the first side; and a second side seal attachment region being along the second side attaching the first zipper profile and second zipper profile along the second side;

(i) the first and second profile members being constructed and arranged to selectively interlock when pressed together and unlock when forced apart;

(ii) the step of securing the second seal flange to the second wall panel includes securing the second seal flange at a zipper-operable section and a zipper-non-operable section;

(A) the zipper-operable section being constructed and arranged so that when a pulling force is applied at the zipper-operable section to the first and second zipper profiles, the first and second profile members will unlock;

(B) the zipper non-operable section being constructed and arranged so that when a pulling force is applied at the zipper-non-operable section to the first and second zipper profiles, the first and second profile members will not unlock; the zipper non-operable section extending along at least a portion of the second zipper profile between the first side seal attachment region and the second side seal attachment region;

(C) the zipper-operable section including a lower attachment region between the second seal flange and the second wall panel, and being between the second profile member and the closed bottom; and an upper attachment region between the second seal flange and the second wall panel, and being between the second profile member and the mouth; and (D) the zipper-non-operable section including at least a lower attachment region between the second seal flange and the second wall panel, and being between the second profile member and the closed bottom; and the zipper-non-operable section being free of attachment between the second seal flange and the second wall panel, and between the second profile member and the mouth.

5. A method according to claim 4 wherein:

(a) the step of securing the first seal flange to the first wall panel includes securing the first seal flange to the first wall panel adjacent along at least an upper attachment region between the first profile member and the mouth, and a lower attachment region between the first profile member and the bottom.

* * * * *